US010890860B2

(12) United States Patent
Tajima

(10) Patent No.: US 10,890,860 B2
(45) Date of Patent: Jan. 12, 2021

(54) SENSOR UNIT AND IMAGE FORMING APPARATUS

(71) Applicant: CANON KABUSHIKI KAISHA, Tokyo (JP)

(72) Inventor: Hirotoshi Tajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/512,847

(22) Filed: Jul. 16, 2019

(65) Prior Publication Data

US 2020/0026218 A1 Jan. 23, 2020

(30) Foreign Application Priority Data

Jul. 19, 2018 (JP) ..... 2018-136193

(51) Int. Cl.
*G03G 21/00* (2006.01)
*G03G 15/08* (2006.01)

(52) U.S. Cl.
CPC ..... *G03G 15/0848* (2013.01); *G03G 21/00* (2013.01)

(58) Field of Classification Search
CPC ..... G03G 15/0848; G03G 15/0855; G03G 21/00; G03G 2215/00042; G03G 2215/0891
See application file for complete search history.

(56) References Cited

U.S. PATENT DOCUMENTS 3,801,196 A * 4/1974 Knapp ..... G03G 15/0855 399/60
3,911,861 A * 10/1975 Griesmer ..... G03G 15/0855 399/59
3,936,176 A * 2/1976 Whited ..... G03G 15/0855 399/49
4,318,610 A * 3/1982 Grace ..... G03G 15/0855 399/49
4,457,615 A * 7/1984 Seanor ..... G03G 15/0216 15/1.51
5,097,293 A * 3/1992 Seto ..... G03G 15/0848 399/11
5,146,274 A * 9/1992 Hattori ..... G03G 15/0849 118/689
9,846,380 B2 12/2017 Tajiri et al.
2008/0131152 A1* 6/2008 Komiya ..... G03G 15/5062 399/49
2018/0335740 A1 11/2018 Kishi et al.

FOREIGN PATENT DOCUMENTS

JP 2011-137979 A 7/2011
JP 2015-197559 A 11/2015

OTHER PUBLICATIONS

Machine translation of JP2015197559 (Year: 2015).*

* cited by examiner

*Primary Examiner* — David J Bolduc
(74) *Attorney, Agent, or Firm* — Venable LLP

(57) ABSTRACT

A sensor unit detachably mounted in a main assembly of an image forming apparatus includes a sensor for detecting a detection object on a surface of a movable member, the sensor having a detecting surface positioned to face the surface of the movable member at least when the sensor detects the detection object; a casing portion accommodating the sensor; an air feeding unit, provided in the casing portion, for taking air in through an inlet portion formed by the casing; and a duct for feeding the air discharged from the air feeding unit to a space between the detecting surface and the surface of the movable member.

9 Claims, 12 Drawing Sheets

(a)

(b)

(a)

(b)

SENSOR UNIT AND IMAGE FORMING APPARATUS

FIELD OF THE INVENTION AND RELATED ART

The present invention relates to a sensor unit which is used in an image forming apparatus such as a copying machine, a printing machine, a facsimile machine, a multi-function machine having two or more functions of the preceding machines, etc. It relates also to an image forming apparatus equipped with a sensor unit such as the one described above.

As a sensor unit for an image forming apparatus, there has been proposed such a sensor unit that has multiple sensors for detecting objects on a moving member, and a casing having openings, through each of which the detection surface of each of the sensors is exposed to the moving member (Japanese Laid-open Patent Application No. 2015-197559). In the case of this type of sensor unit structured as described above, the casing is provided with an intake opening, through which the air in the main assembly of the image forming apparatus is inducted into the casing, and an air passage, through which the inducted air is made to flow out of the casing through the space between the detection surface and the detection openings, in order to prevent the problem that contaminants such as toner adhere to the detection surface. Further, the sensor unit disclosed in the first patent document is structured so that air is indirectly inducted from an external fan.

However, in the case of a sensor unit such as the one disclosed in Japanese Laid-open Patent Application No. 2015-197559, that is structured to indirectly induct air from an external fan, the air discharged by the fan partially disperses in the air passage between the fan and the air intake opening of the sensor unit, making it difficult to stabilize the sensor unit in the amount by which air flows through the unit. Therefore, the sensor unit is likely to be unstable in the amount by which air is made to flow into the casing through the intake opening, and flow out of the casing. Therefore, it is impossible to ensure that air is flowed toward the toner particles scattered from the moving member, making it likely for the detection surface of the sensor to be soiled.

SUMMARY OF THE INVENTION

Thus, the primary object of the present invention is to provide a sensor unit which is stable in the amount by which air is sent to the space between its detection surface and moving member.

According to an aspect of the present invention, there is provided a sensor unit detachably mounted in a main assembly of an image forming apparatus, said sensor unit comprising a sensor configured to detect a detection object on a surface of a movable member, said sensor having a detecting surface positioned to face the surface of said movable member at least when said sensor detects the detection object; a casing portion accommodating said sensor; an air feeding unit provided in said casing portion and configured to take air in through an inlet portion formed by said casing; and a duct configured to feed the air discharged from said air feeding unit to a space between the surface of the movable member.

Further features of the present invention will become apparent from the following description of exemplary embodiments with reference to the attached drawings.

Figure 8:
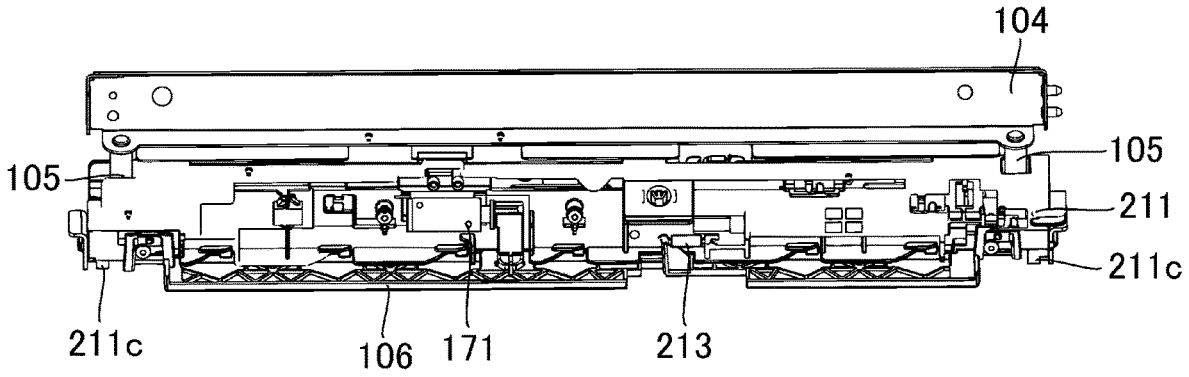
Figure 8:
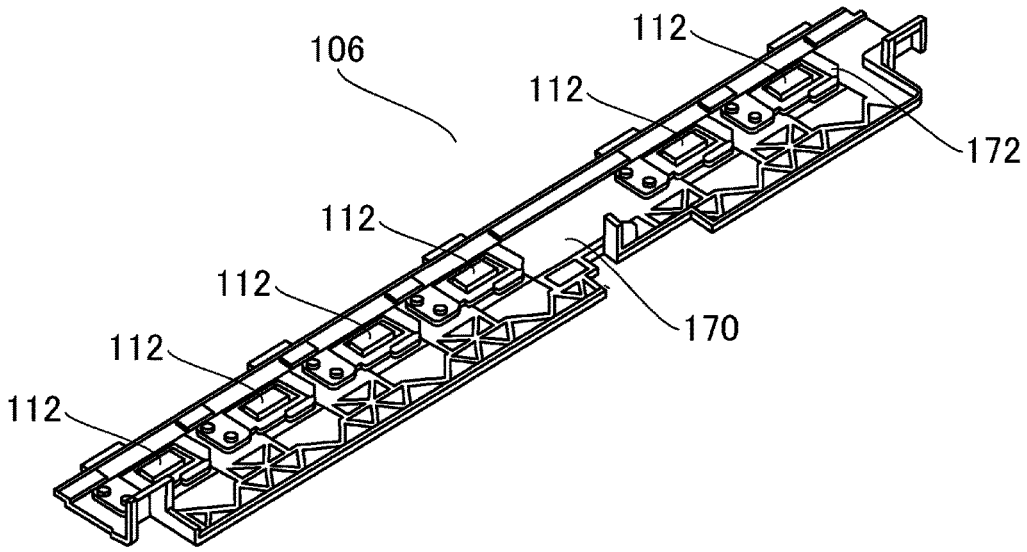

Part (a) of FIG. 8 and part (b) of FIG. 8 are a side view, and a perspective view, of the shuttering member, respectively, when the shuttering member is remaining closed.

Figure 9:
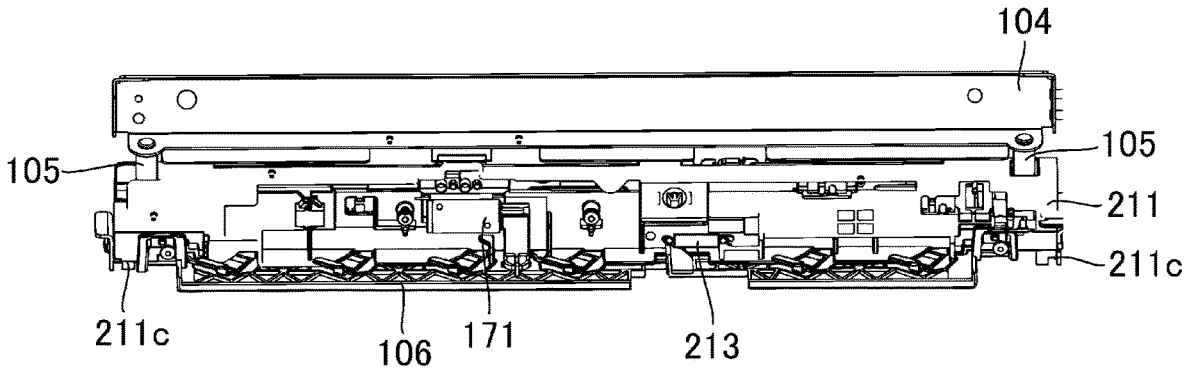
Figure 9:
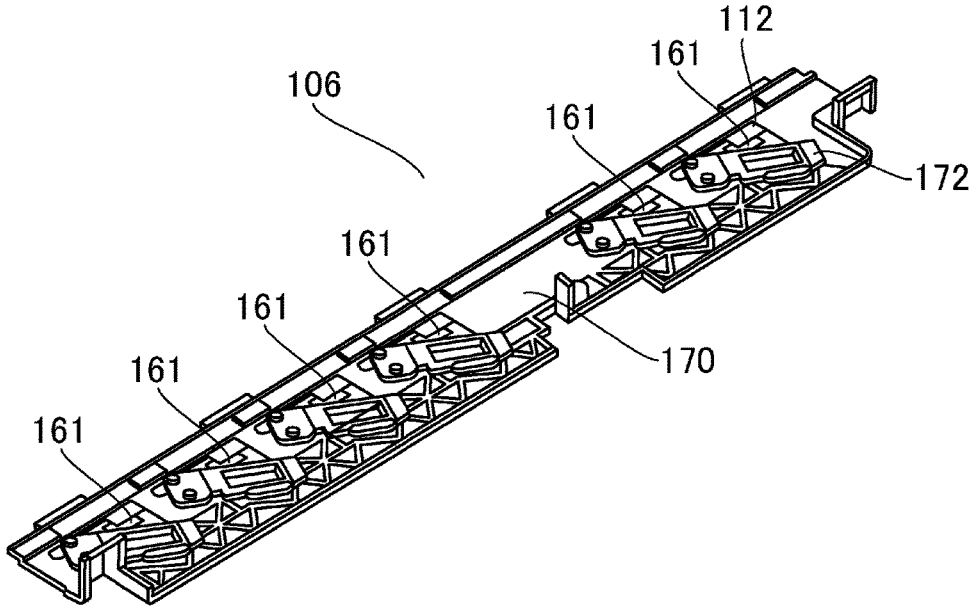

Part (a) of FIG. 9 and part (b) of FIG. 9 are a side view, and a perspective view, of the shuttering member, respectively, when the shuttering member is open.

Figure 10:
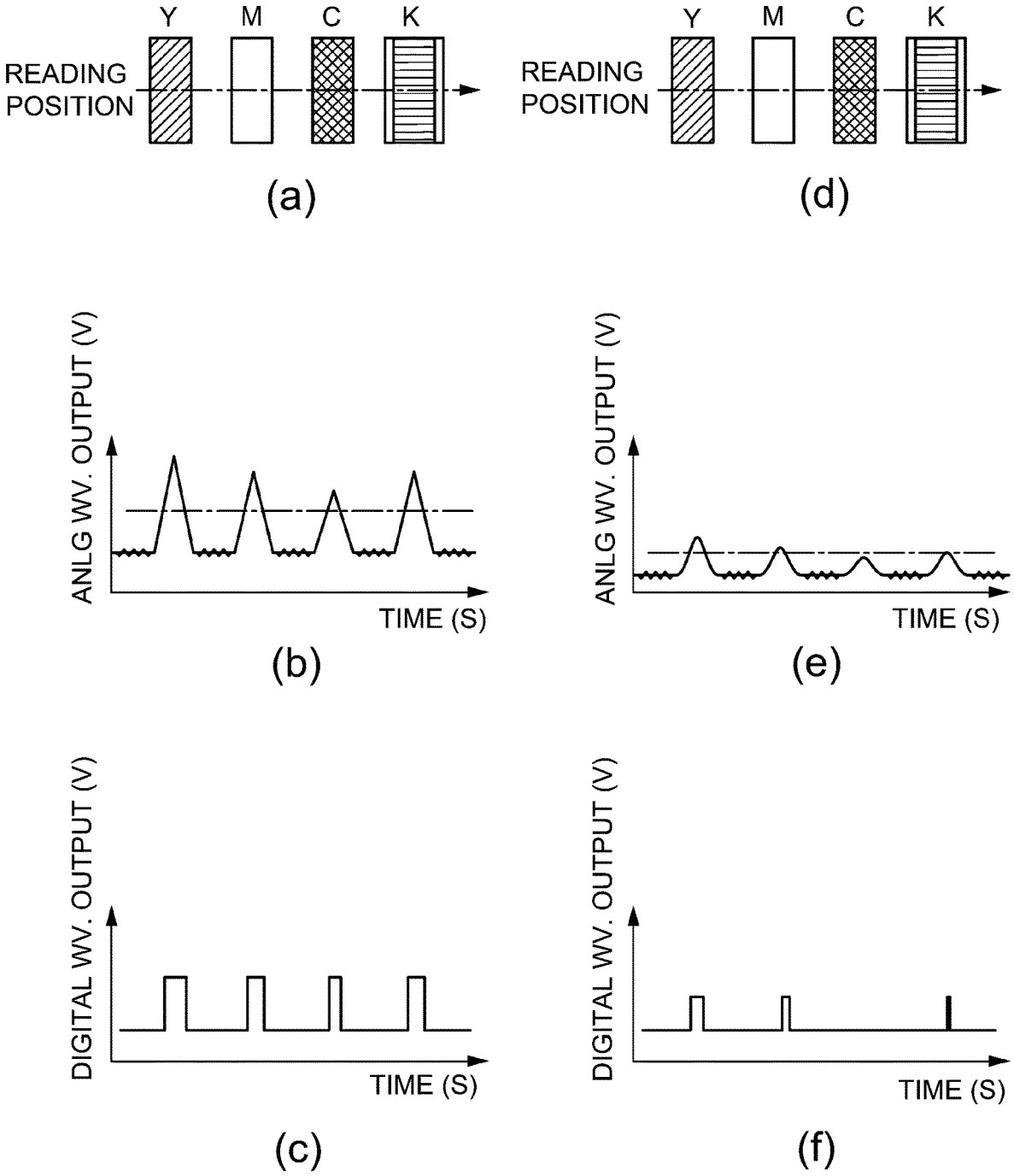

Parts (a)-(f) of FIG. 10 show the relationship among the registration patches (part (a)), waveform of analog output (part (b)) of the sensor unit, and waveform (part (c)) of the digitized output of the sensor unit, when the registration sensors are not soiled, and the relationship among the registration patches (part (d)), waveform of analog output (part (e)) of the sensor unit, and waveform (part (f)) of the digitized output of the sensor unit, when the registration sensors are soiled.

Figure 11:
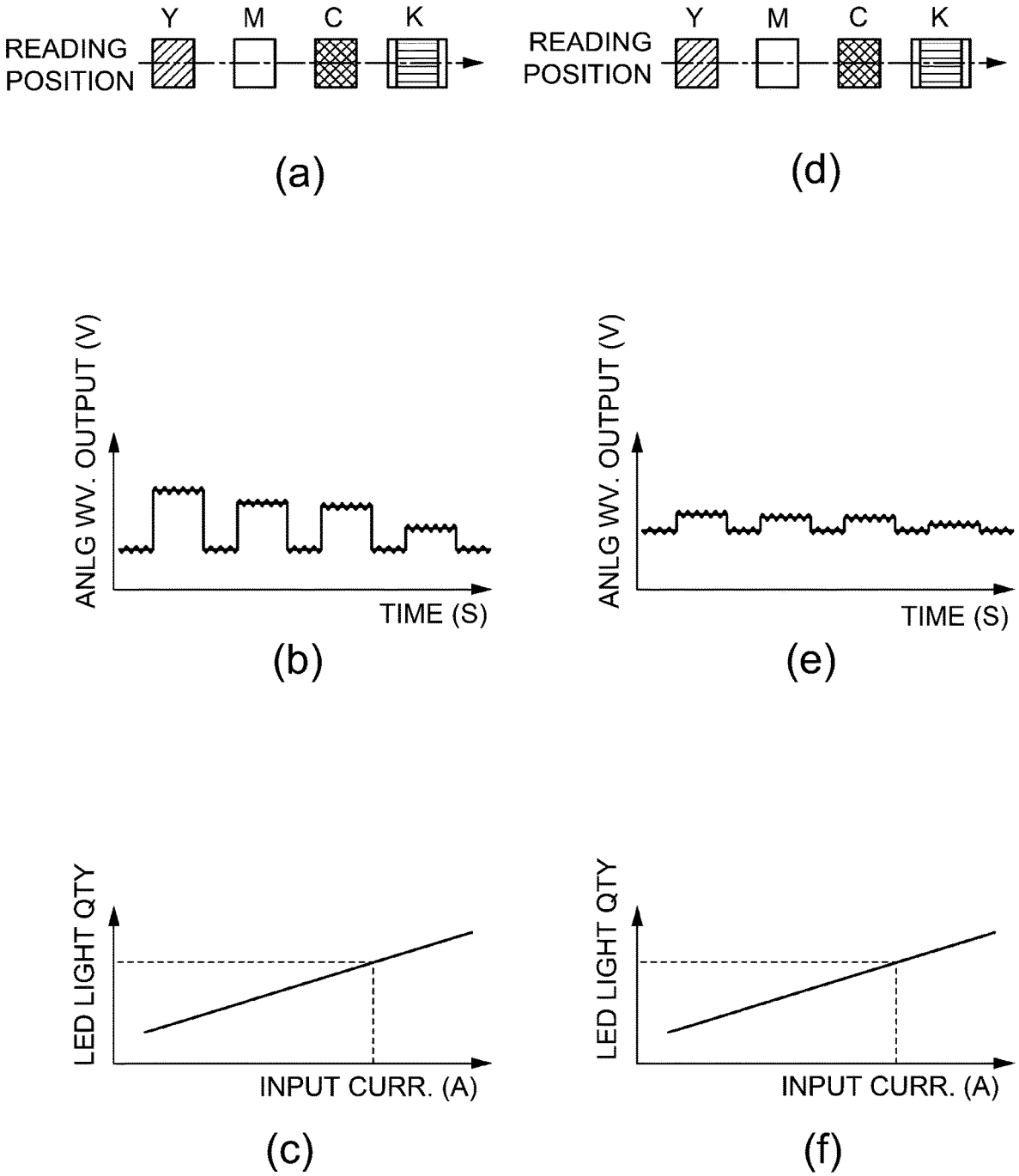

Parts (a)-(f) of FIG. 11 show the relationship among the density patches (part (a)), waveform of analog output (part (b)) of the sensor unit, and LED output (part (c)) of the digitized output of the sensor unit, when the density sensors are not soiled, and the relationship among the density patches (part (d)), waveform of analog output (part (e)) of the sensor unit, and LED output (part (f)) of the digitized output of the sensor unit, when the registration sensors are soiled.

Figure 12:
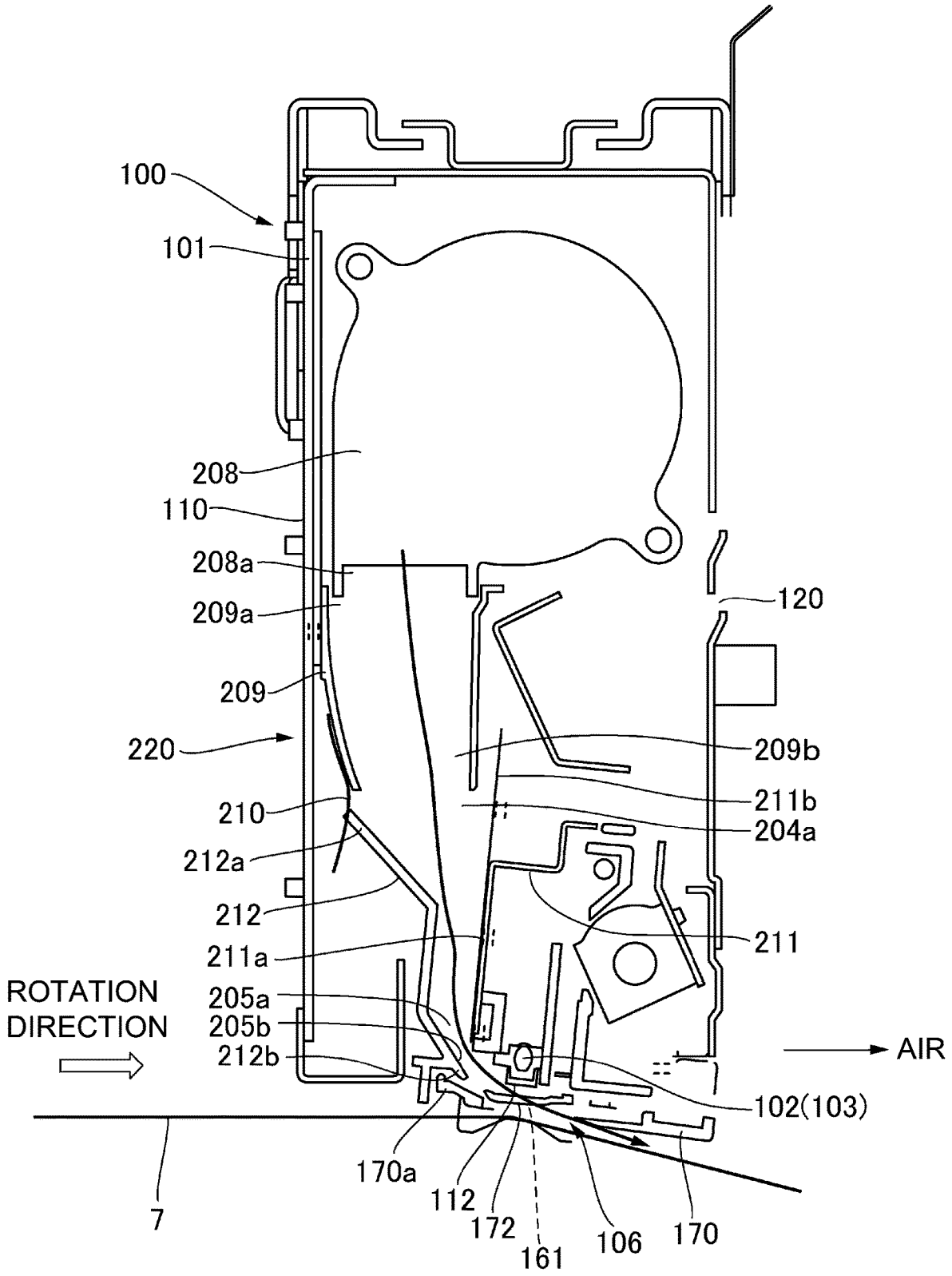

FIG. 12 is sectional view of the sensor unit in this embodiment, at a plane which is parallel to the rotational direction of the intermediary transfer belt.

Figure 13:
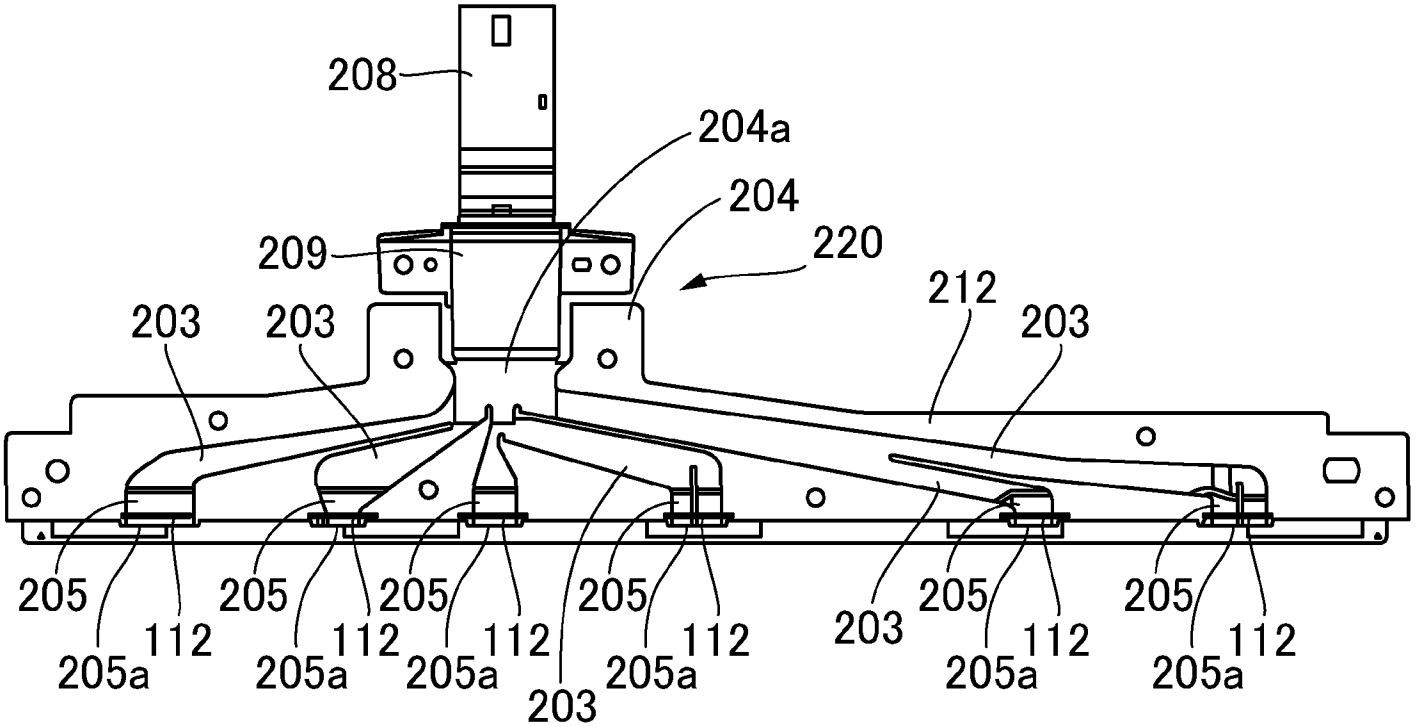

FIG. 13 is a sectional view of the sensor unit in this embodiment, at a plane which is intersectional to the rotational direction of the intermediary transfer belt.

Figure 14:
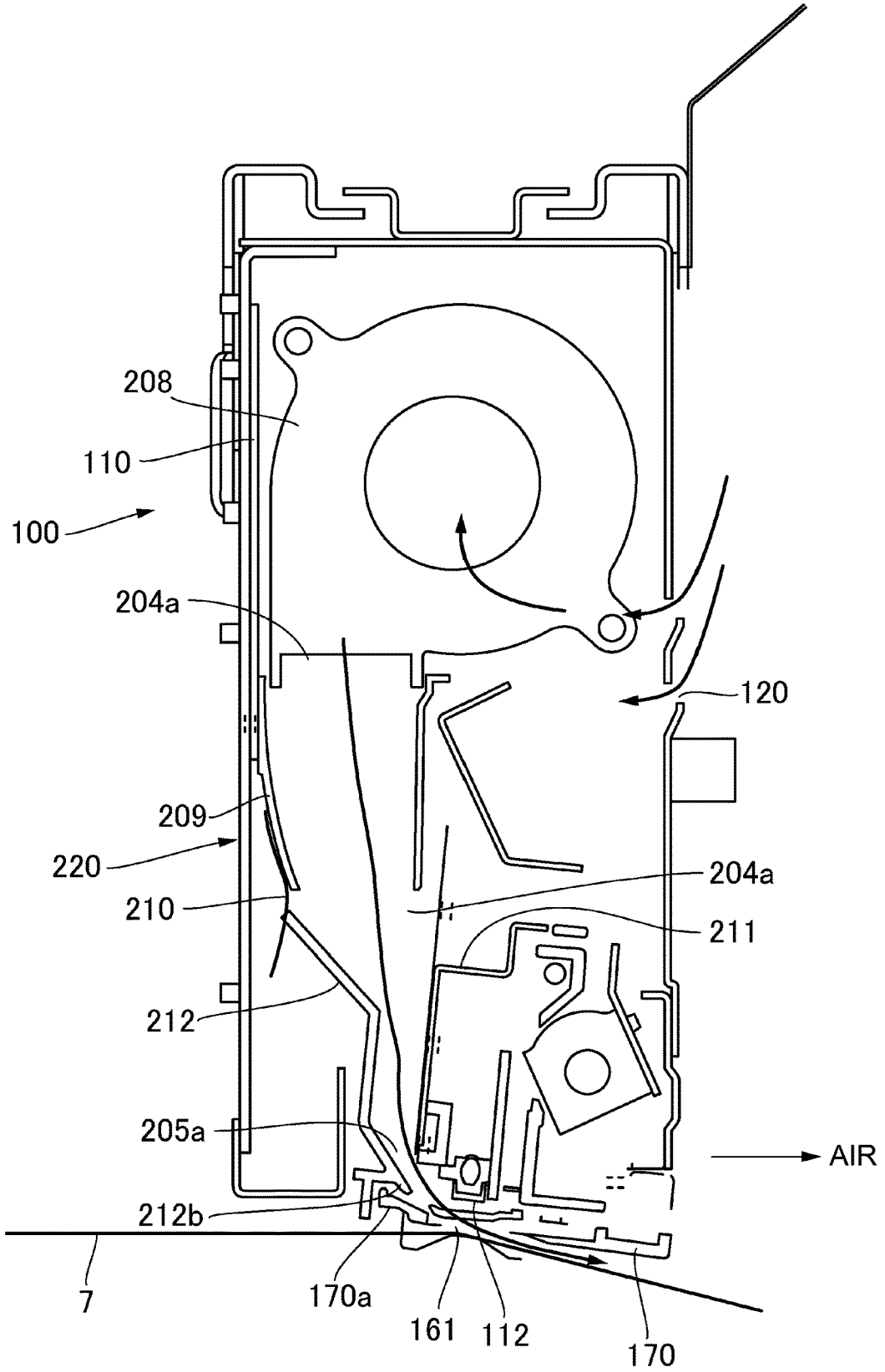

FIG. 14 is a sectional view of the sensor unit in this embodiment, which shows the direction of the airflow in the adjacencies of the sensor unit.

DESCRIPTION OF THE EMBODIMENTS

Hereinafter, referring to FIGS. 1 to 14, the present invention is described with reference to one of the preferred embodiments of the present invention. To begin with, referring to FIG. 1, the general structure of the image forming apparatus in this embodiment is described.

[Image Forming Apparatus]

The image forming apparatus 10 in this embodiment is a color copying machine which is capable of forming a full-color image with the use of one of electrophotographic methods. It is of the so-called intermediary transfer type, and also, of the so-called tandem type. The image forming apparatus 10 has multiple (four) image forming portions, more specifically, the first to fourth image forming portions (stations) PY, PM, PC and PK, which form yellow (Y), magenta (M), cyan (C), and black (K) images, respectively. In this embodiment, the image forming portions PY, PM, PC and PK are practically the same in structure and operation, although they are different in the color of the toner they use. Therefore, the first image forming portion PY is primarily described; the other image forming portions are not described.

Figure 1:
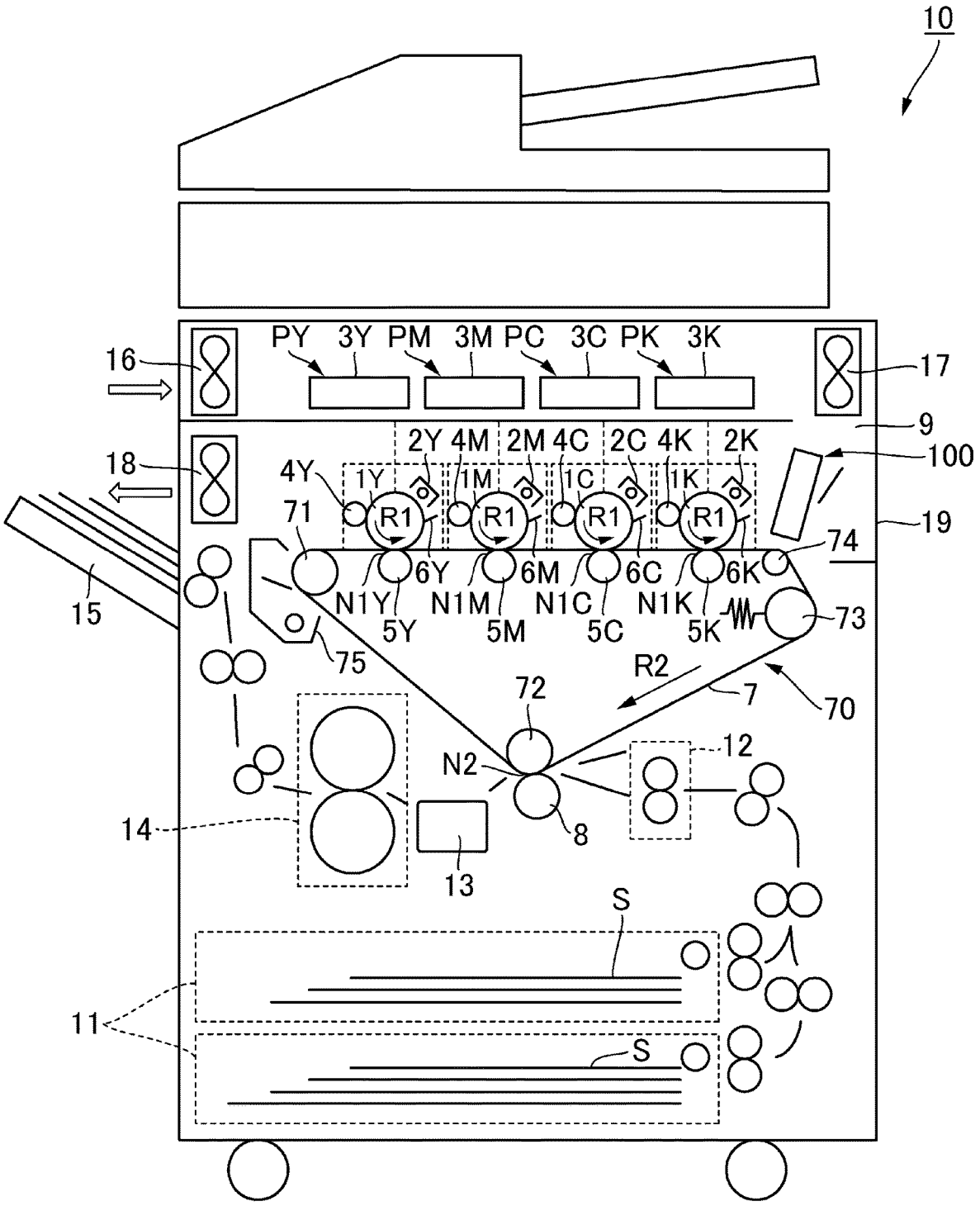
FIG. 1 is a sectional view of the image forming apparatus in one of the preferred embodiments of the present invention; it shows the general structure of the apparatus.

In the following description of the present invention, the portion of the image forming apparatus 10 that corresponds in position to the surface of the sheet of paper, on which FIG. 1 is formed, is referred to as the front side (surface) of the image forming apparatus 10, and the portion of the image forming apparatus 10 that corresponds in position to the rear surface of the sheet is referred to as the rear side (rear surface) of the image forming apparatus 10. Here, the front side of the image forming apparatus 10 means the side from which an operator operates the image forming apparatus 10. It is the side having a portion for operating the image forming apparatus 10. Further, the left and right sides of the image forming apparatus 10 are the left and right sides as the image forming apparatus 10 is seen from its front side. It is assumed here that the depth direction, or the direction which connects the front and rear sides, is roughly parallel to the rotational axis of the photosensitive drum 1Y, which will be described later.

The image forming portion PY is provided with a photosensitive drum 1Y as an image bearing member. The photosensitive drum 1Y is an electrophotographic member (photosensitive member) which is in the form of a drum (cylindrical). The photosensitive drum 1Y is rotationally driven in the direction indicated by an arrow mark R1 in FIG. 1, by a driving motor (unshown) as a driving means. The image forming portion PY is provided with the following apparatuses, more specifically, a charging device 2Y as a charging means, an exposing apparatus (laser scanning apparatus) as an exposing means, a developing apparatus 4Y as a developing means, a primary transfer roller 5Y as the primary transferring member which is in the form of a roller, and a drum cleaner 6Y as a means for cleaning the photosensitive drum 1Y. These apparatuses are disposed in the listed order, in the adjacencies of the peripheral surface of the photosensitive drum 1Y, in a manner to surround the photosensitive drum 1Y in the direction parallel to the rotational direction of the photosensitive drum 1Y.

As the photosensitive drum 1Y is rotated, it is uniformly charged by the charging device 2Y. Then, the charged peripheral surface of the photosensitive drum 1Y is scanned by the exposing apparatus 3Y (scanned by beam of light from exposing apparatus 3Y). As a result, an electrostatic latent image (electrostatic image) is formed on the peripheral surface of the photosensitive drum 1Y. This electrostatic latent image is developed by the developing apparatus 4Y which uses toner as developer.

By the way, the exposing apparatus 3Y is provided with a laser and multiple mirrors. The laser is controlled in light emission by image formation signals. The multiple mirrors are for guiding the beam of laser light to the peripheral surface of the photosensitive drum 1Y. The timing with which a latent image begins to be written can be adjusted by adjusting the exposing apparatus in the timing with which the beam of laser light is emitted, and also, adjusting the mirrors, in order to adjust the image forming apparatus 10 at the point on the peripheral surface of the photosensitive drum 1Y, at which a latent image begins to be written. Further, the image forming apparatus 10 can be adjusted in image density by adjusting the potential level to which the peripheral surface of the photosensitive drum 1Y is to be charged, and also, adjusting the exposing apparatus 3Y in the intensity of the laser light.

On the other hand, the image forming apparatus 10 is provided with an intermediary transfer belt 7 as an intermediary transferring member which is in the form of an endless belt. The intermediary transfer belt 7 is on the bottom side of the combination of the photosensitive drums 1Y, 1M, 1C and 1K, being disposed in a manner to horizontally penetrate each of the image forming portions PY, PM, PC and PK. The intermediary transfer belt 7 is an example of a movable member, to which the present invention is related. It is disposed in a manner to wrap around a combination of multiple supporting rollers (suspending and tensioning rollers), more specifically, a driving roller 71, a roller 72 which opposes the secondary transferring member, a tension roller 73, and a backup roller 74.

As driving force is inputted into the driving roller 71 from a driving motor (unshown) as a driving means, the intermediary transfer belt 7 rotates (circularly moves) in the direction indicated by the arrow mark R2 in the drawing. The tension roller 3 remains pressed outward from the inward side of the loop (belt loop) which the intermediary transfer belt 7 forms. That is, the intermediary transfer belt 7 remains suspended by the abovementioned supporting rollers while being subjected to a preset amount of tension. Further, the image forming apparatus 10 is provided with primary transfer rollers 5Y, 5M, 5C and 5K, which also are positioned on the inward side of the loop which the intermediary transfer belt 7 forms, being disposed in a manner to oppose the photosensitive drums 1Y, 1M, 1C and 1K, respectively.

The primary transfer roller 5Y is kept pressed toward the photosensitive drum 1Y with the presence of the intermediary transfer belt 7 between the primary transfer roller 5Y and photosensitive drum 1Y. Therefore, the primary transferring portion N1Y (primary transfer nip), which is the interface between the intermediary transfer belt 7 and photosensitive drum 1Y, is formed between the intermediary transfer belt 7 and photosensitive drum 1Y.

Further, the image forming apparatus 10 is provided with a secondary transfer roller 8 as the secondary transferring means, which is the secondary transferring member and is in the form of a roller. The secondary transfer roller 8 is disposed on the outward side of the loop which the intermediary transfer belt 7 forms, in such a manner that it opposes the roller 72 (which opposes secondary transfer roller 8). The secondary transfer roller 8 is kept pressed toward the roller 72 with the presence of intermediary transfer belt 7 between the secondary transfer roller 8 and roller 72. Thus, the secondary transferring portion N2 (secondary transfer nip), or the interface between the secondary transfer roller 8 and roller 72, is formed.

Further, the image forming apparatus 10 is provided with the belt cleaner 75 as a means for cleaning the intermediary transfer belt 7, which also is disposed on the outward side of the loop which the intermediary transfer belt 7 forms, in a manner to oppose the driving roller 71. The belt unit 70 comprises the intermediary transfer belt 7, belt supporting rollers 71, 72, 73 and 75, belt cleaner 75, etc.

After the formation of a toner image on the peripheral surface of the photosensitive drum 1Y, the toner image is transferred (primary transfer) onto the intermediary transfer belt 7 by the function of the primary transfer roller 5Y, to which the primary transfer voltage (primary transfer bias) is applied, in the primary transferring portion N1Y. For example, in an operation for forming a full-color image, first, a yellow toner image is transferred onto the intermediary transfer belt 7 in the first image forming portion PY. Then, magenta, cyan, and black toner images are sequentially transferred onto the intermediary transfer belt 7 in the second, third, and fourth image forming portions PM, PC and PK, respectively, in a manner to be layered upon the preceding toner image on the intermediary transfer belt 7. Then, the layered toner images on the intermediary transfer belt 7 are transferred (secondary transfer) onto a sheet S of recording medium such as a sheet of recording paper by the function of the secondary transfer roller 8, to which the secondary transfer voltage (secondary transfer bias) is being applied, in the secondary transferring portion N2. For example, in an operation for forming a full-color image, the four layered toner images, different in color, on the intermediary transfer belt 7 are transferred together onto a sheet S of recording medium. A sheet S of recording medium is fed into the main assembly 9 of the image forming apparatus 10 from a storage 11 of a transferring medium supplying portion. Then, it is corrected in attitude in a registering-and-attitude-correcting portion 12. Then, it is conveyed to the secondary transferring portion N2.

After the transfer of the toner images onto a sheet S of recording medium, the sheet S is borne on a conveyance belt 13, which is an endless conveying member. Then, it is conveyed further. The conveyance belt 13 is driven by a driving motor (unshown) as a driving means. The image forming apparatus 10 is provided with a suction fan (unshown) for keeping a sheet S of recording medium adhered to the conveyance belt 13. The suction fan is disposed on the inward side of the loop which the conveyance belt 13 forms. Thereafter the sheet S is conveyed to a fixing apparatus 14, as a fixing means, which is disposed on the downstream side of the conveyance belt 13 in terms of the recording medium conveyance direction. Then, the sheet S is heated and pressed by the fixing apparatus 14. Consequently, the toner images become fixed to the sheet S. That is, a permanent full-color image is formed on the sheet S. Thereafter, the sheet S is conveyed to a transfer medium discharging portion, and then, is discharged into a delivery tray 15, which is outside the main assembly 9 of the image forming apparatus 10.

After the primary transfer, the adherent matters such as toner (primary transfer residual toner) which are remaining on the photosensitive drum 1Y are removed from the photosensitive drum 1Y by the belt cleaner 75, and then, are recovered. Further, the adherent matters such as toner (secondary transfer residual toner) which are remaining on the intermediary transfer belt 7 after the secondary transfer are removed from the intermediary transfer belt 7 by the belt cleaner 75 and are recovered.

The image forming apparatus 10 has a sensor unit 100, which is disposed on the downstream side of the primary transferring portion N1K, or the most downstream one, in terms of the direction in which a sheet S of recording medium is conveyed, in such a manner that it opposes the outward surface of the intermediary transfer belt 7, on the upstream side of the secondary transferring portion N2. The sensor unit 100 has registration sensors 102 and density sensors 103 (FIG. 2, for example), each of which is an optical sensor. The aforementioned backup roller 74 is disposed in a position which opposes the sensor unit 100 which is on the inward side of the loop which the intermediary transfer belt 7 forms. The sensor unit 100 will be described later in detail.

Further, the image forming apparatus 10 has the first and second intake fans 16 and 17, which are for generating airflow in the main assembly 9 (which hereafter may be referred to simply as apparatus main assembly 9) of the image forming apparatus 10, by drawing air into the apparatus main assembly 9 from outside the apparatus main assembly 9. The first intake fan 16 is attached to the left side wall of the casing 19 (main assembly casing) of the apparatus main assembly 9. It is by the first intake fan 16 that the air for cooling the image forming portions PY, PM, PC and PK, in particular, exposing apparatuses 3Y, 3M, 3C and 3K, is drawn into in their adjacencies, from the left side wall toward the right side wall. The second intake fan 17 is attached to the right side wall of the apparatus main assembly 9. It is by the second intake fan 17 that the airflow for cooling the interior (internal space) of the main assembly 9 of the image forming apparatus 10 is generated. It is by these airflows that the elements of the each of the image forming portions PY, PM, PC and PK, except for those of each exposing apparatus, are prevented from excessively increasing in temperature.

Moreover, the image forming apparatus 10 has an exhaust fan 18 for exhausting air from within the apparatus main assembly 9 to generate airflow in the apparatus main assembly 9. The reason why temperature increases in the apparatus main assembly 9 is attributable to the fixing apparatus 14. Therefore, the exhaust fan 18 is disposed above the fixing apparatus 14 in order to prevent the interior of the apparatus main assembly 9 from excessively increasing in temperature. The exhaust fan 18 is attached to the left side wall of the main assembly casing 19. It exhausts the internal air of the apparatus main assembly 9 rearward. As air is drawn into the apparatus main assembly 9 from outside the apparatus main assembly 9 by the second intake fan 17, it flows toward the exhaust fan 18.

[Controlling Portion]

Figure 2:
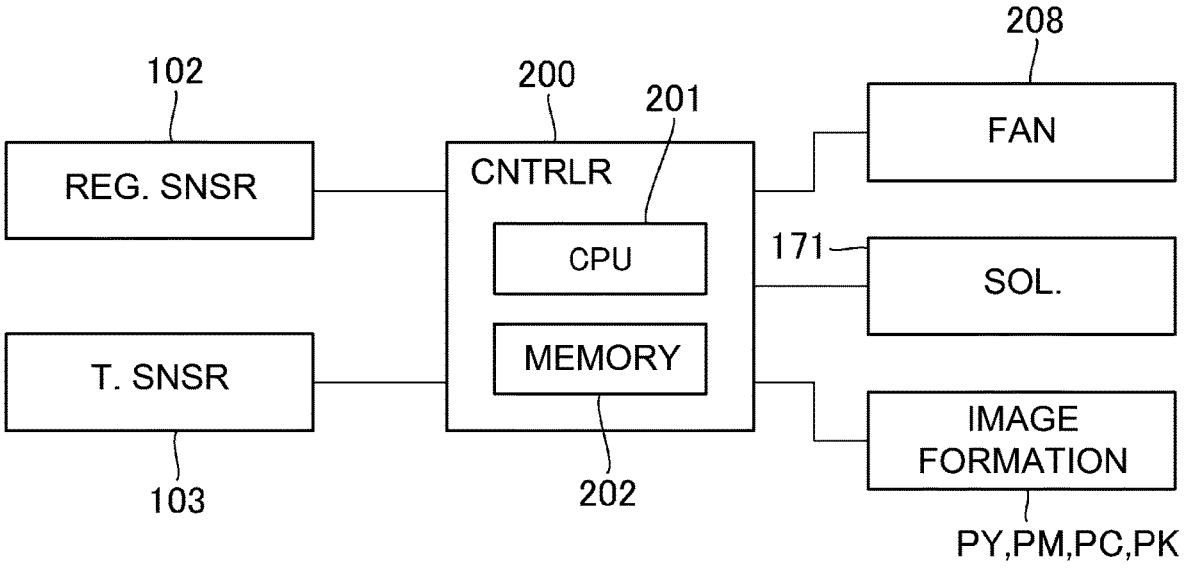
FIG. 2 is a block diagram of a part of the structure of the control portion of the image forming apparatus in this embodiment.

FIG. 2 shows the general structure of the controlling portion of the image forming apparatus 10 in this embodiment, which controls the essential portions of the image forming apparatus 10. The controlling portion 200, as a controlling means, with which the image forming apparatus 10 is provided, comprises: a CPU 201 which is the principal element for computation; and memories such as a ROM and a RAM, each of which is a storage element. In the RAM, the results of detection by the sensors, results of computation, etc., are stored. In the ROM, control programs, pre-obtained data tables, or the like, are stored. In this embodiment, the controlling portion 200 integrally controls each of various portions of the image forming apparatus 10. In this embodiment, the controlling portion 200 corrects the image forming portions PY, PM, PC and PK based on the results of the detection by the registration sensors 102 and density sensors 103, to adjust the image forming apparatus 10 in the point at which each of the monochromatic images which are different in color begins to be written, and also, in image density. Further, the controlling portion 200 controls the driving of the solenoid 171 for opening or closing the shutter of the sensor unit 100, as will be described later in detail.

[Sensor Unit]

Next, the sensor unit 100 is described. First, referring to FIG. 3, the overall structure and operation of the sensor unit 100 are described. Roughly speaking, the sensor unit 100 is dividable into a casing 110, registration sensors 102, density sensors 103, a sensor holder 211, an anti-soiling fan 208, and a duct 220. The casing 110, as a supporting portion, functions as the external frame for the sensor unit 100. The multiple sensors, more specifically, the registration sensors 102 and density sensors 103 detect the registration patches and density patches, as objects to be detected, on the surface of the intermediary transfer belt 7 as a moving member. The sensor holder 211, as a holding portion, is supported by the casing 110. It holds the registration sensors 102 and density sensors 103. The fan 208, as an airflow generating means, is fixed (attached) to the casing 110. The duct 220 is held to the upstream side of sensor holder 211, in terms of the direction parallel to the rotational direction of the intermediary transfer belt 7. It sends the air discharged from the fan 208, to the registration sensors 102 and density sensors 103. Next, each of the various portions of the sensor unit is described in detail.

[Casing]

Figure 3:
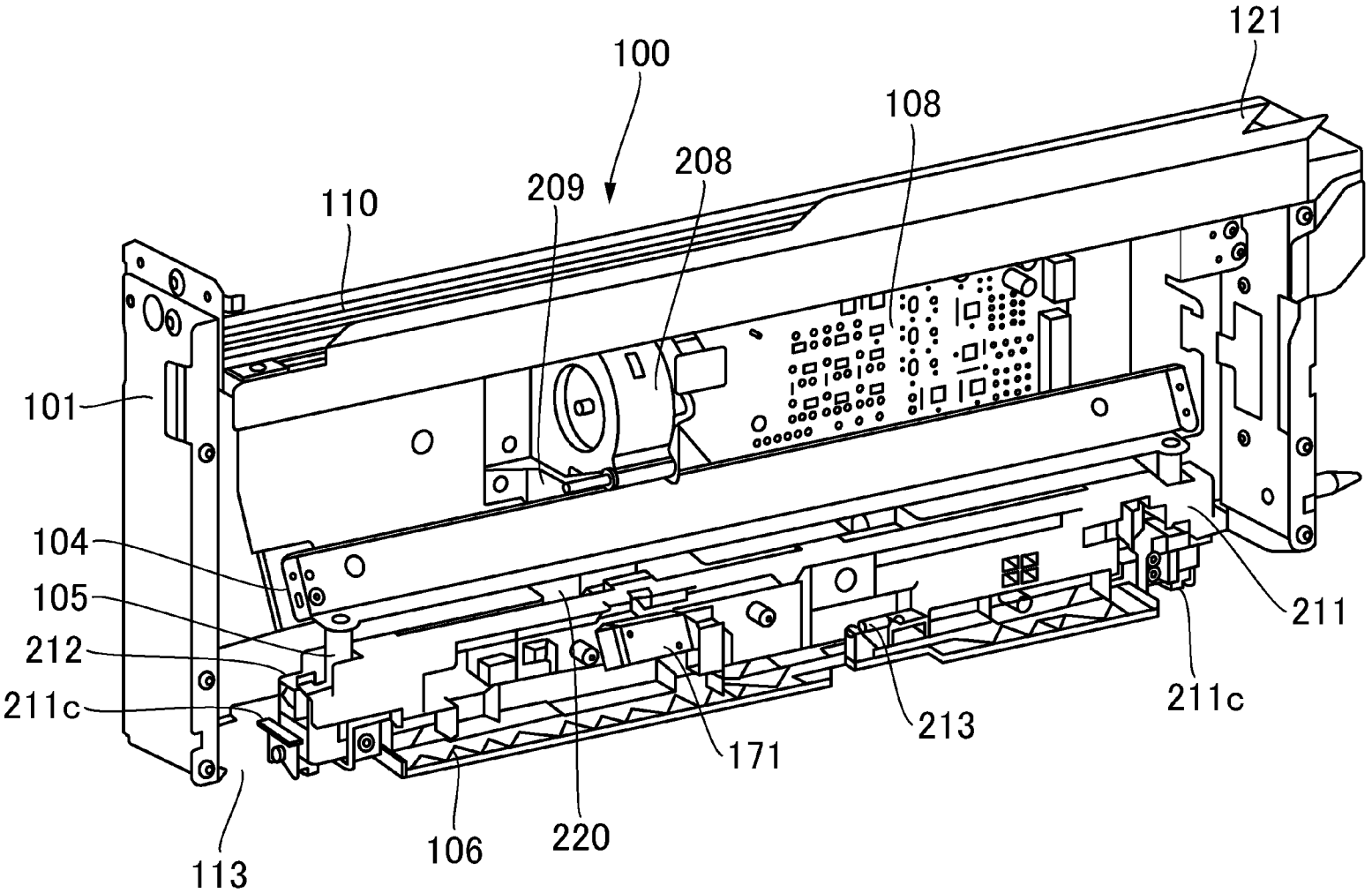
FIG. 3 is an internal perspective view of the sensor unit in this embodiment.
Figure 4:
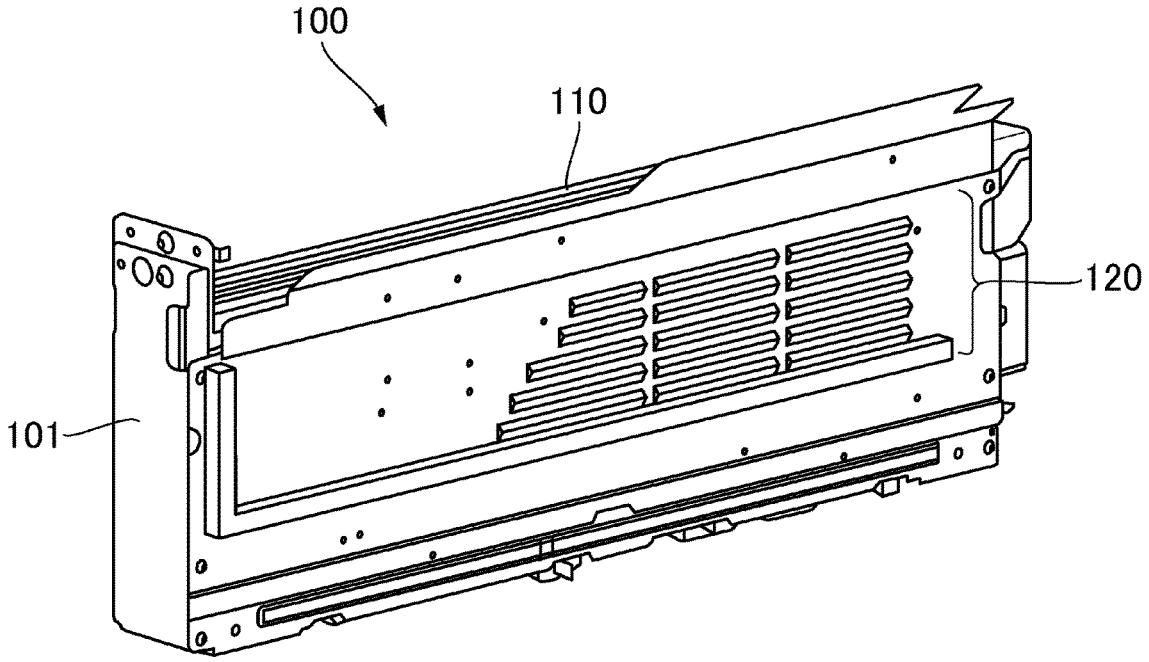
FIG. 4 is an external perspective view of the sensor unit in this embodiment.

Referring to FIGS. 3 and 4, the casing 110 is in the form of a long-and-narrow rectangular parallelepiped. It is disposed so that its long edges are roughly perpendicular to the widthwise direction of the intermediary transfer belt 7. A frame 101 by which the sensor unit 100 is fixed to the image forming apparatus 100 is the base portion of the casing 110. Referring to FIG. 3, the sensor unit 100 is provided with a sensor holder supporting plate 104, an electrical circuit 108, a fan 208, etc., which are fixed to the inward surface (left surface of casing 110, within supporting portion). The sensor holder supporting plate 104 supports the sensor holder 21. The electrical circuit 108 processes the electrical signals which are to be sent to the registration sensors 102, density sensors 103, and the solenoid 171 for opening or closing the shutter. The fan 208 is a soiling prevention fan, which is employed as a mechanism for preventing sensors from being soiled, which will be described later.

Next, referring to FIG. 4, the casing 110 is provided with air induction openings 120, through which the air, which is flowing within the main assembly 9 of the image forming apparatus 10, is drawn into the casing 110. Referring to FIG. 3, the bottom wall of the casing 110 is provided with detection openings 113, through which the detection surface of each registration sensor 102, and that of each density sensor 103, are exposed to the intermediary transfer belt 7.

Figure 5:
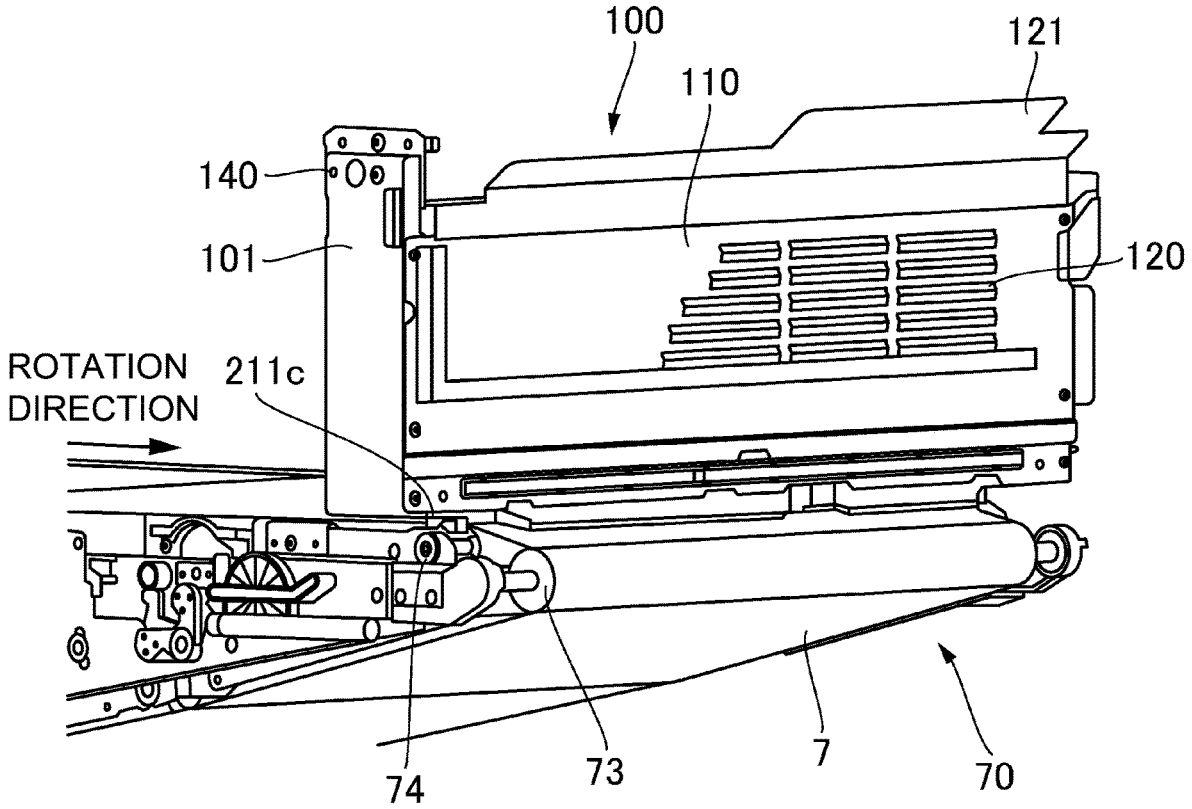
FIG. 5 is a perspective view of a combination of the sensor unit and belt unit in this embodiment.

Next, referring to FIG. 5, the sensor unit 100 and image forming apparatus 10 are structured so that the former is removably installable in the main assembly 9 of the latter. As the sensor unit 100 is inserted into the apparatus main assembly 9, a positioning portion 140, with which the frame 101 of the casing 110 of the sensor unit 100 is provided, fits into an unshown portion, with which the frame of the main assembly 9 of the image forming apparatus 10 is provided, whereby the sensor unit 100 becomes fixed to the apparatus main assembly 9. During this process, the sensor unit 100 is positioned so that it opposes the surface of the intermediary transfer belt 7.

[Sensors]

The multiple sensors, more specifically, the registration sensors 102 and density sensors 103, are such sensors that detect a toner image on the surface of the intermediary transfer belt 7, which is the object of detection. Each of the registration sensors 102 and density sensors 103 has a detection surface 112 (FIG. 12, for example, which will be described later) which faces the surface of the intermediary transfer belt 7. Each registration sensor 102 is an optical sensor for reading a referential image (which hereafter may be referred to as a registration-patch), which is a toner image formed on the intermediary transfer belt 7 to correct the image forming apparatus in color deviation. Each density sensor 103 is an optical sensor for reading the referential image (which hereafter may be referred to as a density patch), which is a toner image formed on the intermediary transfer belt 7 to correct the image forming apparatus in image density.

Figure 6:
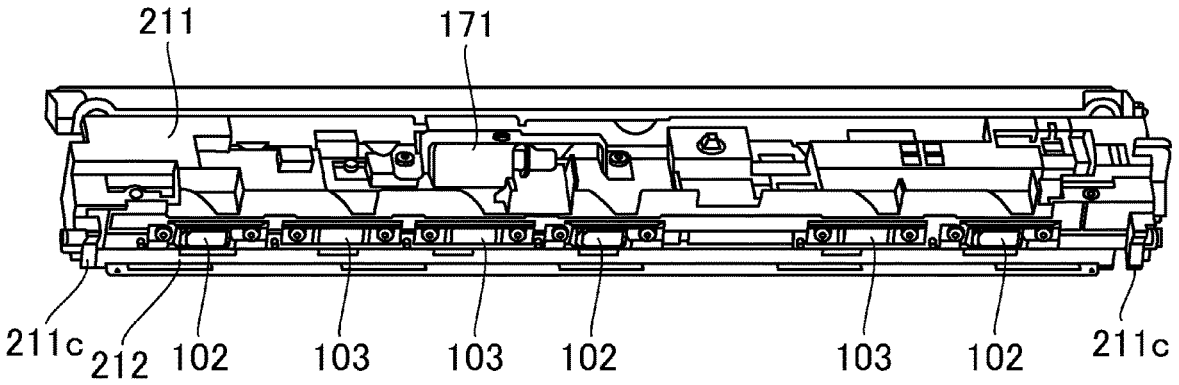
FIG. 6 is a perspective view of the sensor holder in this embodiment.

Referring to FIG. 6, the sensor unit 100 is provided with three registration sensors 102, which are in alignment in the widthwise direction of the intermediary transfer belt 7. It is based on the results of detection of yellow, magenta, and cyan registration patches by these sensors 102 that the amount of color deviation is calculated for each color. Here, the amounts of deviation include the deviation in the position at which an electrostatic latent image begins to be written for each color, in terms of the direction in which the intermediary transfer belt 7 is conveyed, and also, in terms of the widthwise direction of the intermediary transfer belt 7, the angular deviation of each of the toner images, different in color, relative to the referential direction, and the deviation in the magnification (scale) of each of the toner images, different in color. Each of the calculated amounts of deviation is processed by the controlling portion 200 (FIG. 2), and is fed back to the image forming operation.

Also referring to FIG. 6, the sensor unit 100 is provided with three density sensors 103, which are aligned in the widthwise direction of the intermediary transfer belt 7. It is based on the results of detection of yellow, magenta, cyan and black density patches by these sensors 103 that the amount of deviation in density is calculated for each color. Each of the calculated amounts of deviation in density is processed by the controlling portion 200 (FIG. 2), and is fed back to the controlling of each image forming portion. By the way, in this embodiment, the sensor unit 100 is provided with multiple registration sensors 102 and density sensors 103. However, this embodiment is not intended to limit the present invention in scope in terms of the number of the registration sensors 102 and that of the density sensors 103.

[Sensor Holder]

Referring to FIG. 6, the sensor holder 211 holds the registration sensors 102 and density sensors 103. A sensor holder such as the sensor holder 211 is movably supported relative to the casing 110. More concretely, referring to FIG. 3, the sensor holder supporting plate 104 is fixed to the casing 110, and the sensor holder 211 is supported by the sensor holder supporting plate 104, with the placement of a pair of supporting springs 105, as elastic members, between the sensor holder supporting plate 104 and sensor holder 211. Thus, the sensor holder 211 is allowed to move in the direction which is perpendicular to the surface of the intermediary transfer belt 7 (height direction of image forming apparatus 10).

Further, the sensor unit 100 is provided with a pair of sensor positioning portions 211*c*, which are positioned at the front and rear ends of the sensor unit 100, one for one. As the sensor unit 100 is inserted into the apparatus main assembly 9, the sensor positioning portions 211*c* are made to come into contact with unshown sensor positioning portions, with which the belt unit 70 is provided, by the pressure from the support springs 105. Therefore, the distance between the registration sensors 102 and density sensors 103, which are held by the sensor holder 211, and the surface of the intermediary transfer belt 7, remains stable at a preset value.

The stopper portions are parts of the axle of the backup roller 74, which is on the inward side of the loop the intermediary transfer belt 7 forms. Each stopper portion is a bearing, for example, by which the backup roller 74 is rotatably supported. That is, the axle of the backup roller 74 is provided with the pair of stopper portions, in order to prevent the intermediary transfer belt 7 from laterally deviating in position. With the provision of this structural arrangement, the sensors remain stable in performance. In this embodiment, it is the axle of the backup roller 74 that is provided with the stopper portions for preventing the lateral deviation of the intermediary transfer belt 7. However, this embodiment is not intended to limit the present invention in scope in terms of the choice of the stopper portion. That is, it may be a pair of supporting members such as a pair of metallic plates.

Further, the sensor holder 211 is provided with the shuttering member 106, and the solenoid for opening or closing the shuttering member 106.

[Shutter]

Figure 7:
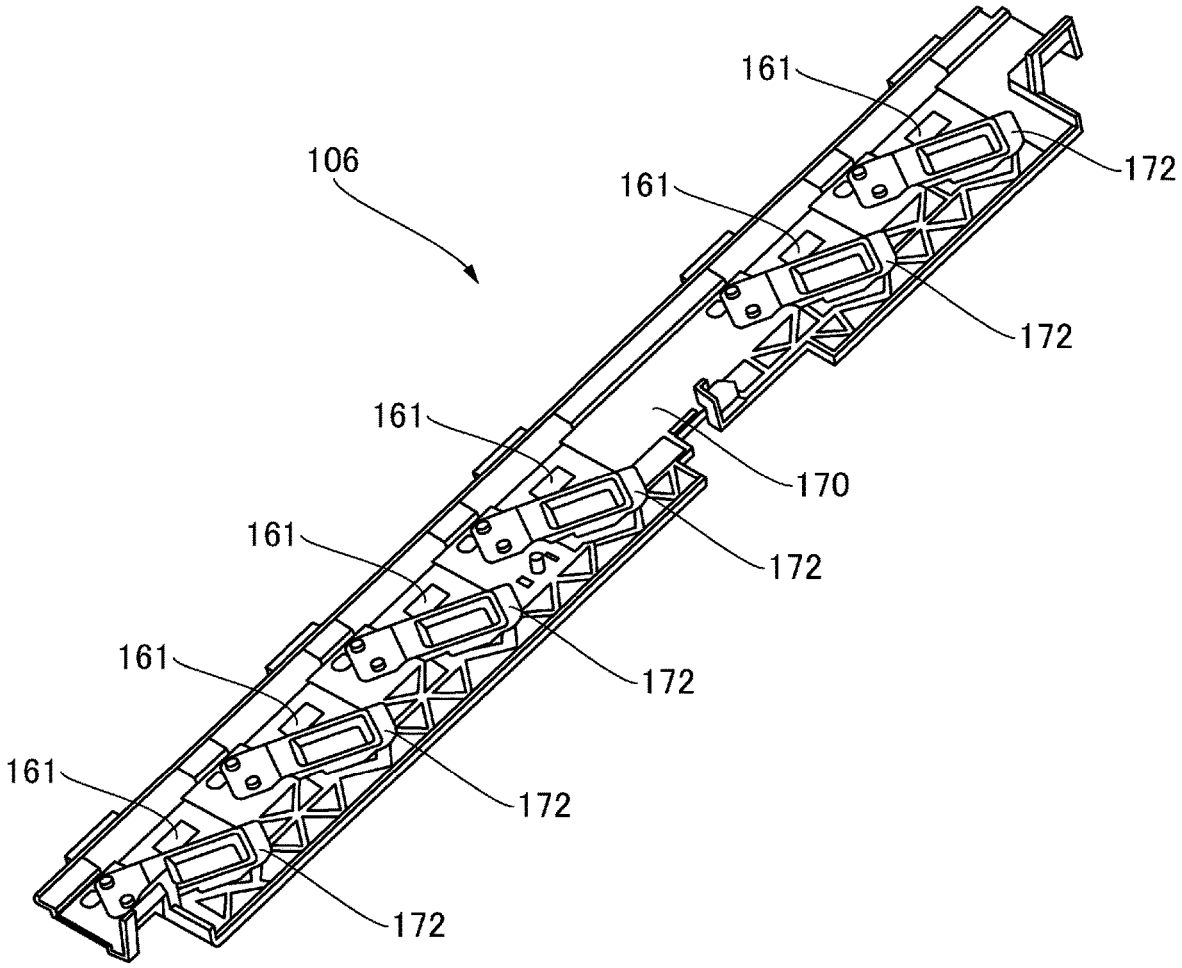
FIG. 7 is a perspective view of the shutter in this embodiment.

Next, referring to FIGS. 7-9(*b*), the shuttering member 106 is described. The shuttering member 106 is supported by the sensor holder 211, being thereby positioned between the detection surface of each registration sensor 102 and the surface of the intermediary transfer belt 7, and also, between each density sensor 103 and the surface of the intermediary transfer belt 7. By the way, the shuttering member 106 may be supported by the casing 110. The shuttering member 106 is movable to a position (which hereafter may be referred to as open position) in which the detection surfaces 102 are exposed to the surface of the intermediary transfer belt 7, and a position (which hereafter may be referred to as closed position), in which the shuttering member 106 blocks the detection surfaces 112 from the surface of the intermediary transfer belt 7. The shuttering member 106 is moved by the solenoid 171 as a shutter driving portion.

Referring to FIG. 7, the shuttering member 106 has a linking member 170 and multiple rotational shutters 172. The linking member 170 is a roughly rectangular plate. It is disposed so that its lengthwise direction is parallel to the widthwise direction of the intermediary transfer belt 7. The rotational shutters 172 are positioned so that each rotational shutter 172 opposes a corresponding registration sensor 102 or density sensor 103. Each rotational shutter 172 rotates about a part of the linking member 170.

The linking member 170, as a moving member, is attached to the sensor holder 211 in such a manner that it can be slid in the direction parallel to the widthwise direction of the intermediary transfer belt 7. It has openings 161 through which the detection surface 112 of each of the registration sensors 102 and density sensors 103 can be exposed to the surface of the intermediary transfer belt 7. That is, as the linking member 170 is moved to its open position, each opening 161 of the linking member 170 opposes the corresponding detection surface 112, whereas as the linking member 170 is moved into the closed position, each opening 161 is displaced from the position at which it opposes the corresponding detection surface 112.

Each rotational shutter 172, as a covering member, is moved by the movement of the linking member 170, to an open position, in which it is away from the corresponding opening 161, and a closed position in which it keeps the opening 161 covered. In this embodiment, each rotational shutter 172 is rotatably supported by the linking member 170. It is rotated by the sliding of the linking member 170.

At this point in time, the state of shuttering member 106, in which the shuttering member 106 remains open, and that in which the shuttering member 106 remains closed, are concretely described. First, the state (closed state) of the shuttering member 106, in which the shuttering member 106 is in its closed position, is described. Referring to part (a) of FIG. 8 and part (b) of FIG. 8, as the solenoid 171 is turned off (driving of shutter driving portion is stopped), the linking member 170 is made to slide rearward of the apparatus main assembly 9 by the resiliency of a tension spring 213, as a pressuring member. Further, the rotational shutter 172 is rotated by the sliding movement of the linking member 170, about a part of the linking member 170. Consequently, not only each opening 161 of the linking member 170 no longer opposes the corresponding detection surface of registration sensor 102, or that of the density sensor 103, but also, each rotational shutter 172 covers the corresponding detection surface 112 of the registration sensor 102, or that of the density sensor 103 (closed state). Therefore, it is possible to prevent toner from adhering to the detection surface 112 of the registration sensor 102 and that of the density sensor 103.

Next, the state of the shuttering member 106, in which it is in its open position (open state), is described. Referring to part (a) of FIG. 9 and part (b) of FIG. 9, as the solenoid 171 is turned on (shutter driving portion is driven), the linking member 170 slides frontward of the apparatus main assembly 9 against the resiliency of the tension spring 213. Thus, each rotational shutter 172 is rotationally moved by the sliding movement of the linking member 170, about the part of the linking member 170. Consequently, not only does each opening 161 of the linking member 170 oppose the corresponding detection surface 112 of the registration sensor 102, or that of the density sensor 103, but also, each rotational shutter 172 is moved into a position in which it does not cover the corresponding detection surface 112 of the registration sensor 102, or that of the density sensor 103. Therefore, the detection surface 112 of each registration sensor 102 and that of each density sensor 103 oppose the surface of the intermediary transfer belt 7 (open state). Further, it becomes possible to detect the toner images on the intermediary transfer belt 7 by the registration sensors 102 and density sensors 103.

[Soiling of Detection Surface of Sensor]

Next, referring to parts (a)-(f) of FIG. 10 and parts (a)-(f) of FIG. 11, the effects of the soiling of the detection surface 112 of the registration sensor 102 and that of the density sensor 103 are described. As the detection surface 112 of the registration sensor 102 and that of the density sensor 103 are exposed to the toner which scattered from the toner images on the intermediary transfer belt 7, for example, they become soiled. As the detection surfaces 112 are soiled, the sensor unit 100 reduces in accuracy.

First, referring to part (a) of FIG. 10—part (f) of FIG. 10, the effects of the soiling of the detection surface 112 of the registration sensor 102 are described. Part (a) of FIG. 10 part (c) of FIG. 10 show the relationship between the registration patches and sensor outputs when the detection surface 112 of the registration sensor 102 and that of the density sensor 103 are unsoiled (clean). Part (d) of FIG. 10—part (f) of FIG. 11 show the relationship between the registration patches and sensor outputs when the detection surface 112 is soiled (dirty).

When the detection surface 112 of the registration sensor 102 is unsoiled, the waveform of the analog output of the registration sensor 102 looks as shown in part (b) of FIG. 10. This drawing shows the results of the reading of the registration patch by the optical sensor as the registration sensor 102 which detects the diffusely reflected light. The optical sensor for detecting diffusively reflected light is relatively small in output when the object of detection is black (K). Therefore, the colored patches are sandwiched by the black patches to even the outputs. As the analog output of each optical sensor, which has the waveform shown in part (b) of FIG. 10, is digitized, a waveform shown in part (c) of FIG. 10 is obtained.

The amount of color deviation for each color patch is obtained based on the difference between the amount by which light is reflected by the intermediary transfer belt 7 and that by each patch, which are detected by the registration sensor 102. It is based on these differences that the amount by which the exposing apparatuses are to be adjusted in the position at which an electrostatic latent image begins to be written, is calculated by the controlling portion 200. If the detection surface 112 of the registration sensor 102 is soiled, the waveform of the analog outputs read by the registration sensor 102 looks as shown in part (e) of FIG. 10.

As the detection surface 112 of the registration sensor 102 becomes soiled, not only does the amount of difference between the amount by which light is reflected by the surface of the intermediary transfer belt 7, and that by each patch, reduce, but also the edge of each patch becomes blurry. Therefore, if the outputs, the waveform of which looks as shown in part (e) of FIG. 10, are digitalized, the waveform of the output becomes as shown in part (f) of FIG. 10. It is evident from the comparison between part (f) of FIG. 10 and part (c) of FIG. 10 that as the detection surface 112 of the registration sensor 102 becomes soiled, it sometimes occurs that it becomes difficult for the controlling portion 200 to pinpoint the center of each patch, and/or the registration sensor 102 erroneously reads the patches. If the controlling portion 200 fails to pinpoint the center of each patch, and/or erroneously read the patches, the actual amount of positional deviation of each patch becomes different from the measured amount of difference, making it impossible for the controlling portion 200 to properly adjust each exposing apparatus in the position at which each exposing apparatus is to begin writing an electrostatic latent image. Consequently, the color deviation occurs.

Next, referring to part (a) of FIG. 11—part (f) of FIG. 11, the effects of the soiling of the detection surface 112 of the density sensor 103 are described. Part (a) of FIG. 11—part (c) of FIG. 11 show the density patches, and the outputs of the density sensor 103 when the detection surface 112 of the density sensor 103 is unsoiled. Part (d) of FIG. 11—part (f) of FIG. 11 show the relationship between the density patches and the outputs of the density sensor 103 and amount of LED light when the detection surface 112 of the density sensor 103 is soiled. The density patches in part (a) of FIG. 10 and the density patches in part (d) of FIG. 11 are the same.

When the detection surface 112 of the density sensor 103 is clean, the waveform of the analog outputs of the density sensor 103 looks as shown in part (b) of FIG. 11. In order to control the image forming apparatus 10 in image density, a referential level of density has to be set. For example, this referential level of density is obtained by reading the density of a density reference member with which the shuttering member 106 is provided, and which is correspondent in position to the density sensor 103, and making adjustments so that the density sensor 103 provides a preset amount of output.

Referring to part (c) of FIG. 10 and part (f) of FIG. 11, the density sensor 103 can be adjusted in output by adjusting the amount by which electrical current is supplied to the LED as the light source, or the like measure. Then, the image forming apparatus 10 is adjusted in image density based on the referential level of density described above, and the read level of density of the patch. That is, the amount of difference between the amount by which light is reflected by the referential density member, and the amount by which light is reflected by each patch, is measured by the density sensor 103. Then, image density of each patch is measured with reference to this difference. Then, the amount by which the image forming apparatus 10 is to be adjusted in image density is calculated by the controlling portion 200, based on this measured amount of difference.

However, if the detection surface 112 of the density sensor 103 is soiled after the setting of the referential density level, the waveform of the output of the density sensor 103 becomes as shown in part (e) of FIG. 11, being different in level from the one before the detection surface 112 of the density sensor 103 is soiled. That is, as will be evident from the comparison between part (e) of FIG. 11 and part (b) of FIG. 11, even though the density patch read after the soiling of the detection surface 112 of the density sensor 103 is the same as the one read before the soiling, the output of the density sensor 103 after the soiling is different from the one before the soiling. Thus, the controlling portion 200 erroneously controls the image forming apparatus 10 in image density. Issues similar to this one also occur if the density reference member is soiled before the referential level of density is set; the detection surface 112 of the density sensor 103 is dirty; and/or both the density reference member and the detection surface 112 of the density sensor 103 are soiled.

[Soiling Prevention by Airflow]

In this embodiment, therefore, airflow is used to prevent the problem that toner or the like soiling causing matters adheres to the detection surface 112 of the registration sensor 102 and that of the density sensor 103. That is, the image forming apparatus 10 is structured so that the airflow is generated by a soiling prevention fan 208 disposed in the sensor unit 100, and is guided by a duct 220, shown in FIGS. 12-14, to cause the airflow to flow along the detection surface 112 and blow out through the openings 161, in order to prevent toner and/or the like from adhering to the detection surface 112. In this embodiment, the duct 220 is disposed so that the air sent to the space between the detection surface 112 and the surface of the intermediary transfer belt 7 flows in the same direction as the rotational direction (preset direction) of the intermediary transfer belt 7. By the way, FIG. 12 shows the state of the sensor unit 100 when the shuttering member 106 is closed. However, it includes a dotted line which shows where the openings 161 are when the shuttering member 106 is open. FIG. 14 shows the state of the sensor unit 100 when the shuttering member 106 is open.

[Duct]

Next, referring to FIGS. 12 and 13, the duct 220 is described. To begin with, airflow is generated in the main assembly 9 of the image forming apparatus 10, and also, in the sensor unit 100, by the second intake fan 17 (FIG. 1) or the like. The right side wall of the frame 101 within the sensor unit 100 is provided with an intake opening 120, which is an opening for taking air into the casing 110. In terms of the airflow generated by the second intake fan 17, the intake opening 120 is disposed on the downstream side of the second intake fan 17, to allow the airflow to be guided into the casing 110 by a stator 121 (FIGS. 3 and 5).

Referring to FIG. 12, the fan 208, with which the casing 110 is provided, takes air into the casing 110 through the intake opening 120. Then, the air from the fan 208 is sent to the registration sensor 102 and density sensor 103 through the duct 220. In the case of this structural arrangement, the fan 208 is disposed slightly frontward of the center of the sensor unit 100. Further, the duct 220 is disposed on the upstream side of the registration sensor 102 and density sensor 103 in terms of the direction parallel to the rotational direction of the intermediary transfer belt 7. Further, the sensor unit 100 is provided with an exhaust opening 205*a*, which faces the space between the detection surface 112 and the surface of the intermediary transfer belt 7. Therefore, the air sent through the duct 220 flows in the direction parallel to the rotational direction (preset direction) of the intermediary transfer belt 7, along the surface of the intermediary transfer belt 7. As described above, the sensor unit 100 is structured so that the direction in which air is discharged from the duct 220 is the same as the rotational direction of the intermediary transfer belt 7. Therefore, it is prevented that the toner images on the intermediary transfer belt 7 are disturbed by the air discharged from the duct 220.

The duct 220 has a relay duct 209 as the first duct portion, and a second duct 212 as the second duct portion. The relay duct 209 is directly supported by the casing 110. It is in connection to the exhaust opening 208*a* of the fan 208 by its intake opening 209*a*. The sensor duct 212 is supported by the sensor holder 211. It has: an intake portion 204 which is in connection to the relay duct 209 in such a manner that it is movable relative to the relay duct 209; multiple branch portions 203 which extend from the intake portion 204; and multiple exhaust portions 205 as shown in FIG. 13.

As air is discharged by the fan 208, it is guided to the intake portion 204 of the sensor duct 212, through the relay duct 209. The intake portion 204 has an intake opening 204*a* which is in connection to the exhaust opening 209*b* of the relay duct 209. Therefore, the intake opening 204*a* takes in the air from the fan 208. As the air flows into the intake opening 204*a*, the intake opening 204*a* sends the air to the multiple branch duct portions 203, which are greater in number than the intake opening 204*a*, as shown in FIG. 13. As a body of air enters the branch duct portions 203, the branch duct portions 203 separate the body of air into multiple smaller bodies of air, and send them to the registration sensors 102 and density sensors 103, which are the same in number (six in all in this embodiment) as that of the branch duct portions 203.

As air is sent to the branch duct portions 203 of the sensor duct 212, it is sent to the space between the detection surface 112 of the registration sensor 102 and the intermediary transfer belt 7, and the space between the detection surface 112 of the density sensor 103 and the surface of the intermediary transfer belt 7. That is, as air is guided into the sensor duct 212, it is divisively sent to a total of six portions, which correspond to the registration sensors 102 and density sensors 103, by the multiple branch portions 203. Then, the air in each branch portion 203 of the sensor duct 212 advances to the corresponding exhaust opening 205*a*.

As the air comes out of the exhaust opening 205*a*, it flows along the detection surface 112 of each sensor, and flows to the opening 161 of the shuttering member 106 which is in the state of being open. Then, it flows toward the intermediary transfer belt 7 (movable member) through the opening 161. Therefore, it is possible to prevent the problem that the toner which scattered from the surface of the intermediary transfer belt 7 enters the sensor unit 100. Therefore, it is possible to prevent the detection surface 112 from being soiled by the toner from the intermediary transfer belt 7.

In this embodiment, the sensor duct 212 held by the sensor holder 211 is variable in attitude relative to the fan 208 fixed to the casing 110, and also, relative to the relay duct 209. That is, as described above, the sensor holder 211 is held to the casing 110, with the placement of the support springs 105 between itself and the casing 110, being therefore movable relative to each other. In this embodiment, the sensor holder 211 is perpendicular (height direction of image forming apparatus 10) relative to the surface of the intermediary transfer belt 7. Therefore, it is possible that the movement of the sensor holder 211 will create a gap between the sensor duct 212 fixed to the sensor holder 211 and the relay duct 209, and also that the sensor duct 212 and relay duct 209 interfere with each other.

In a case where a gap occurs between the sensor duct 212 and relay duct 209, the air from the fan 208 leaks through the joint between the relay duct 209 and sensor duct 212. Further, in a case where the sensor duct 212 and relay duct 209 interfere with each other, it is possible that the sensor holder 211 will be prevented from moving.

In this embodiment, therefore, the portion of the sensor duct 212, by which the sensor duct 212 is in connection to the relay duct 209 is tapered (tapered portion 212*a*). The tapered portion 212*a* is shaped so that the closer it is to its tip portion, that is, closer to the relay duct 209, the wider the sensor duct 212 is. Further, the sensor unit 100 is structured so that as the sensor holder 211 is seen in the direction (vertical direction in FIG. 12) in which it moves, the tapered portion of the sensor duct 212 overlaps with the end portion of the relay duct 209. Since the sensor duct 212 is provided with the tapered portion 212*a* as described above, the sensor holder 211 is prevented from moving, by the interference between the sensor duct 212 and relay duct 209, even if the sensor holder 211 moves.

Further, in order to keep sealed the joint between the relay duct 209 and sensor duct 212, the joint is provided with a sealing sheet 210, which is disposed in a manner to sit astride both the end portion of the relay duct 209 and the tapered portion 212*a* of the sensor duct 212. Thus, even if the sensor holder 211 moves, it is possible to prevent the air from the fan 208, from leaking from the joint between the relay duct 209 and sensor duct 212.

Further, as the sensor duct 212 is fixed to the sensor holder 211, it is blocked by a wall portion 211*a*, which is a part of the sensor holder 211, at its right side with reference to FIG. 12. That is, the intake portion 204, and the lateral opening of each of the multiple branch portions 203, are blocked by the wall portion 211*a*. In the case of the illustrated sensor unit 100, a sheet 211*b* is provided between the wall portion 211*a* and sensor duct 212, and this sheet 211*b* is extended to a point which is outside the exhaust opening 209*b* of the relay duct 209. This embodiment, however, is not intended to limit the present invention in the structure of this portion. For example, this portion may be structured so that the openings of the side wall of the intake portion 204, and those of the multiple branch portions 203, are blocked before the sensor duct 212 is fixed to the sensor holder 211.

As described above, the sensor duct 212 in this embodiment has the intake portion 204, multiple branch portions 203, and exhaust portion 205. The intake portion 204 is provided with the intake opening 204*a* through which air is taken in from the fan 208 by way of the relay duct 209. The multiple branch portions 203 are greater in number than the intake opening 204*a*. Thus, as a body of air enters sensor duct 212 through the intake opening 204*a*, the multiple branch portions 203 divide the body of air into the same number of smaller bodies of air as the number of the registration sensors 102 and density sensors 103, and send the smaller bodies of air to the registration sensors 102 and density sensors 103, one for one.

Further, each of the multiple branch portions 203 is provided with its own exhaust portion 205, which is provided with the exhaust opening 205*a*, through which the air is discharged after being moved through the branch portion 203. Referring to FIG. 13, each exhaust opening 205*a* is aimed toward the detection surface 112 of the corresponding sensor. That is, the exhaust portion 205 is shaped in such a manner that its air passage substantially curves across its downstream portion in terms of the direction in which air flows in the branch portions 203.

Further, among the inside walls of the exhaust portion, the inside wall 205*b*, that is, the one which is one opposite from the detection surface 112 of each sensor, is tilted to guide air along the detection surface 112 as the air flows out of the exhaust portion 205. That is, referring to FIG. 12, the inside wall 205*b* is tilted so that the more downstream it is in terms of the direction of the airflow, the closer it is to the registration sensor 102 (or density sensor 103).

Further, the end portion of the sensor duct 212, which is on the exhaust opening 205*a* side, that is, the downstream end portion of the sensor duct 212 in terms of the direction in which air is sent, is provided with a hood 212*b*, in order to aggressively supply the detection surface 112 of each sensor with the air discharged from the sensor duct 212. On the other hand, the shuttering member 106 is provided with an overlapping portion 170*a*, which is the upstream end portion of the sensor duct 212 in terms of the direction of the airflow, and which overlaps with the hood 212*b* of the downstream end portion of the sensor duct 212 in terms of the direction in which the air is sent.

That is, the linking member 170, which is one of the structural components of the shuttering member 106, is provided with the tapered overlapping portion 170*a* for smoothly guiding air, as the air comes out of the hood portion 212*b* of the sensor duct 212. The overlapping portion 170*a* is positioned so that it opposes the hood portion 212*b*, and overlaps with the hood portion 212*b*. Therefore, as air is discharged from the sensor duct 212, it is unlikely for the discharged air to leak upstream in terms of the rotational direction of the intermediary transfer belt 7, through the gap between the awning portion 212*a*, and the overlapping portion 170*a* of the linking member 170.

[Airflow]

In the case of the sensor unit 100 in this embodiment which is structured as described above, the airflow generated by the fan 208 disposed within the sensor unit 100 is guided by the duct 220 so that the air flows along the detection surface 112 of each registration sensor 102 or that of each density sensor 103, and blows out of the opening 161 of the shuttering member 106, in order to prevent toner and/or the like from soiling the detection surface 112 by adhering to the detection surface 112.

At this time, referring to FIG. 14, airflow such as that described above is described. To begin with, as the fan 208 disposed in the sensor unit 100 operates, such airflow as the one shown in FIG. 14 is generated in the sensor unit 100, and also, in the adjacencies of the sensor unit 100.

In order to prevent the toner particles from the toner images on the intermediary transfer belt 7 from scattering into the air in the adjacencies of the intermediary transfer belt 7, the intake opening 120, with which the right side wall of the casing 110 of the sensor unit 100 is provided, is positioned on the top side of the right side wall of the intermediary transfer belt 7, away from the intermediary transfer belt 7. Therefore, the air which will be drawn by the fan 208 is clean. That is, it contains virtually no toner particles which have flown away from the toner images on the intermediary transfer belt 7. Therefore, it is unlikely for the detection surface 112 of each sensor from being soiled by the toner particles in the air discharged by the fan 208.

As for the air discharged by the fan 208 in the casing 110, it is guided to the intake opening 204*a* of the sensor duct 212 held by the sensor holder 211. As the air is introduced into the sensor duct 212, it is divisively distributed to a total of six registration sensors 102 and density sensors 103, and advances to the exhaust opening 205*a*, and is exhausted from the exhaust opening 205*a*. As it is exhausted, it moves along the detection surface 112 of each sensor. Then, it passes by the opening 161 of the shuttering member 106, which opposes the sensors. Then, it flows into the adjacencies of the surface of the intermediary transfer belt 7.

Because the sensor unit 100 in this embodiment is structured as described above, it is possible to prevent the problem that the toner particles from the toner images on the intermediary transfer belt 7 are made to adhere to the detection surface 112 of each sensor, through the opening 161 of the shuttering member 106, by the airflow generated by the fan 208. That is, it is possible to prevent the detection surface 112 from being soiled.

[Fan Control]

Next, the control of the fan 208 is described. While the image forming apparatus 10 is not in an image forming operation, no toner image is on the intermediary transfer belt 7. Therefore, it does not occur that toner particles scatter into the adjacencies of the sensor unit 100. Generally speaking, it has been known that the amount by which air is discharged from the outlet of the fan is reversely proportional to the length of time the fan has been operated. Thus, if the fan 208 is driven while the image forming apparatus 10 is used for an image forming operation, all that occurs is that the fan 208 increases in the cumulative length of its operation, and prematurely reduces in the amount of the airflow it generates. Consequently, the fan 208 reduces in the amount of the air which is discharged by the fan 208 during an actual image forming operation, making it impossible to satisfactorily prevent the detection surface 112 from being soiled.

In this embodiment, therefore, while image forming apparatus 100 is not in an image forming operation, the controlling portion 200 (FIG. 2) does not drive the fan 208. More concretely, the controlling portion 200 drives the fan 208 only during an image forming job. An "image forming job" corresponds to such a period of time in an image forming operation that is between when image formation is started in response to a print signal (image formation signal) for forming an image on recording medium and when image formation is completed. That is, it corresponds to a period of time in which a pre-operation (pre-rotation) to be carried out before an image is actually formed, an actual image forming operation (operation for actually forming image), and a post-operation (post-rotation) to be carried out after the actual image forming operation, are sequentially carried out.

By the way, the image forming apparatus 10 may be designed so that even during an image forming job, the fan 208 is not driven during the pre-rotation and post-rotation. That is, the image forming apparatus 10 may be designed so that the fan 208 is driven only during a period in which an image is actually formed. In either case, by controlling the image forming apparatus 10 in the period in which the fan 208 is driven, it is possible to increase the fan 208 in durability, making it possible to prevent the detection surface 112 of each sensor from being soiled for a long period of time.

[Sensor Accuracy]

[Sensor Accuracy]

As described above, in this embodiment, the casing 110 of the sensor unit 100 is provided with the fan 208. Therefore, as airflow is generated by the fan 208, the fan 208 vibrates as it takes in air and discharges the air. If these vibrations are picked up by the registration sensors 102 and density sensors 103, the sensors reduce in accuracy. In this embodiment, therefore, the support springs 105 are placed between the sensor holder 211, which holds the registration sensor 102 and density sensor 103, and the sensor holder supporting plates 104 fixed to the casing 110. Therefore, the vibrations from the fan 208 are absorbed by the support springs 105, making it possible to prevent the vibrations from affecting the registration sensor 102 and density sensor 103 in accuracy.

As described above, in this embodiment, the casing 110 of the sensor unit 100 is provided with the fan 208. Therefore, the image forming apparatus 10 is stable in the amount by which air is sent to the space between the detection surface 112 of each sensor and the intermediary transfer belt 7. In a case where air is taken in by an external fan as disclosed in Japanese Laid-open Patent Application No. 2015-197559, the air taken in is likely to disperse in the air passage to the induction opening. In comparison, in this embodiment, air is drawn into the sensor unit 100 by the fan 208 which is in the casing 110, and then is sent to the detection surface 112 of each sensor through the duct 220. Therefore, the sensor unit 100 is substantially more stable in the amount by which air is sent to each detection surface 112.

In particular, in this embodiment, the sensor unit 100 (image forming apparatus 10) is structured as described above, and the average speed at which air flows along the surface of the intermediary transfer belt 7 is roughly 4 m/s, compared to roughly 1 m/s in the case of the sensor unit (image forming apparatus) disclosed in Japanese Laid-open Patent Application No. 2015-197559. Therefore, it is possible to prevent the problem that the detection surfaces 112 are soiled by the toner particles and/or the like, and therefore, the sensor unit 100 is reduced in the level of accuracy at which the toner images on the intermediary transfer belt 7 are detected by the registration sensor 102 and/or density sensor 103.

Further, in this embodiment, the support springs 105 are provided between the casing 110, which supports the fan 203, and the sensor holder 211, which supports the registration sensors 102 and density sensors 103. Therefore, it is possible to prevent the problem that the registration sensors 102 and density sensors 103 pick up the vibrations from the components which are in the adjacencies of the sensors, and therefore, the sensors reduce in accuracy.

<Others>

In the embodiment described above, the sensor unit 100 is provided with the shuttering member 106. However, the present invention is applicable to the sensor unit 100 even if the sensor unit 100 is not provided with the shuttering member 106.

Further, in the embodiment described above, the moving member was the intermediary transferring member. The preceding embodiment, however, was not intended to limit the present invention in scope. For example, the present invention is also applicable to an apparatus, the movable member of which is a recording medium bearing member, instead of the intermediary transferring member. That is, the present invention is also applicable to an image forming apparatus of the so-called direct transfer type, which forms an image by directly transferring a toner image onto a sheet of recording medium borne by a recording medium bearing member. As the recording medium bearing member, an endless belt which is similar to the intermediary transfer belt 7 in the embodiment described above may be used. Also in an image forming apparatus of this type, such a control is carried out that referential images (registration patch and density patch) are formed on a recording medium bearing member, or a sheet of recording medium borne by a recording medium bearing member, and these referential images are detected by sensors (registration sensors and density sensors) to correct an image forming apparatus in color deviation and/or image density. Therefore, effects which are similar to those obtainable by the image forming apparatus 10 in the embodiment described above can be obtained by applying the present invention to this type of image forming apparatus.

Further, in the embodiment described above, the sensors (registration sensors and density sensors) were optical sensors. The preceding embodiment, however, is not intended to limit the present invention in scope in terms of sensor selection. That is, the present invention is also applicable to a sensor unit (image forming apparatus) as long as the sensors employed by the sensor unit are such sensors that have a detection surface positioned in a manner to oppose a movable member, and detect the state of an object on the movable member, through their detection surface. For example, the sensor may be a potential sensor for detecting the surface potential of the movable member, as the state of the movable member. A potential sensor is preferably employable in a case where the movable member is a photosensitive member.

According to the present invention, it is possible to stabilize a sensor unit in the amount by which air is sent to the space between the detection surface of a sensor, and a movable member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-136193 filed on Jul. 19, 2018, which is hereby incorporated by reference herein in its entirety.

What is claimed is:

1. An image forming apparatus comprising:

a rotating member configured to rotate and bear a toner image;

a sensor unit provided with a sensor configured to detect the toner image borne on said rotating member, an exposure opening exposing a detection surface of said sensor, and a casing accommodating said sensor;

a fan configured to feed air; and a duct portion, provided in said sensor unit, configured to feed the air fed from said fan to a space between said sensor and said rotating member, wherein said sensor is provided outside of said duct portion and an exhaust opening of said duct portion is provided upstream of the detection surface of said sensor with respect to a rotating direction of said rotating member.

2. The apparatus according to claim 1, wherein said sensor unit is detachably provided in a main assembly of said image forming apparatus and said fan is fixed to said casing.

3. The apparatus according to claim 1, further comprising a shutter member configured to open and close said exposure opening, wherein an upstream end of said shutter member is provided upstream of an upstream end of the exhaust opening of said duct portion with respect to the rotating direction of said rotating member.

4. The apparatus according to claim 1, wherein said sensor includes a first sensor and a second sensor, wherein said duct portion includes a first branch duct portion and a second branch duct portion configured to feed the air fed from said duct portion to the first sensor and said second sensor, respectively, and wherein a discharge port of said fan is provided between said first sensor and said second sensor with respect to a width direction of said rotating member, which is perpendicular to the rotating direction of said rotating member.

5. The apparatus according to claim 1, further comprising a controller configured to control said fan, said controller controlling said fan so that said fan is driven in response to an image formation signal and is stopped driving in response to an end of the image formation signal.

6. The apparatus according to claim 2, further comprising:

a sensor holder holding said sensor; and an elastic member provided between said casing and said sensor holder, wherein said sensor holder is supported by said casing through said elastic member, said duct portion includes a first duct portion fixed to said casing and a second duct portion provided on said sensor holder, and a sheet member is provided between said first and second duct portions to feed the air fed by said first duct portion to said second duct portion.

7. The apparatus according to claim 2, further comprising an inlet port provided on said casing and configured to feed the air outside of said casing to said fan, wherein said inlet port is located on a side wall of said casing which is provided downstream of said sensor with respect to the rotating direction of said rotating member.

8. The apparatus according to claim 2, wherein a discharge port of said fan is provided upstream of said sensor with respect to the rotating direction of said rotating member.

9. The apparatus according to claim 2, wherein said fan is located at a back side of said sensor.

* * * * *